US008354130B2

(12) United States Patent
Tseng

(10) Patent No.: US 8,354,130 B2
(45) Date of Patent: Jan. 15, 2013

(54) SYSTEMS AND METHODS FOR FACILITATING INTAKE OF EDIBLE SUBSTANCES

(76) Inventor: Yi-Ming Tseng, Palo Alto, CA (US)

( * ) Notice: Subject to any disclaimer, the term of this patent is extended or adjusted under 35 U.S.C. 154(b) by 340 days.

(21) Appl. No.: 12/876,258

(22) Filed: Sep. 7, 2010

(65) Prior Publication Data

US 2012/0058229 A1 Mar. 8, 2012

(51) Int. Cl.
*B65D 81/34* (2006.01)

(52) U.S. Cl. ..... 426/115; 426/120; 426/394; 426/392; 206/222; 206/221; 206/219; 220/705; 220/709; 222/145.5

(58) Field of Classification Search ..... 206/219–222, 206/217, 229, 532; 426/106, 112, 115, 120, 426/122, 130, 394, 392, 109; 220/705, 229, 220/709; 222/145.1, 145.5–145.7; 229/103.1
See application file for complete search history.

(56) References Cited

U.S. PATENT DOCUMENTS

| | | | | | |
|---|---|---|---|---|---|
| 2,212,441 | A | * | 8/1940 | Katz | 126/263.03 |
| 3,048,317 | A | * | 8/1962 | Cochrane et al. | 229/103.1 |
| 3,240,403 | A | * | 3/1966 | Modderno | 222/399 |
| 3,321,097 | A | * | 5/1967 | Solowey | 206/221 |
| 3,803,993 | A | | 4/1974 | Graham | |
| D258,796 | S | | 4/1981 | Paulides | |
| 4,408,690 | A | * | 10/1983 | Ferrero | 206/222 |
| 4,557,377 | A | * | 12/1985 | Maloney | 206/219 |
| D284,728 | S | | 7/1986 | Trivison | |
| 4,779,722 | A | * | 10/1988 | Hall | 206/221 |
| 4,955,503 | A | | 9/1990 | Propes | |
| D320,911 | S | | 10/1991 | Carlson | |
| 5,209,348 | A | | 5/1993 | Schafer, III | |
| 5,241,835 | A | | 9/1993 | Ascone | |
| D340,625 | S | | 10/1993 | Wang | |
| 5,261,532 | A | * | 11/1993 | Fauci | 206/218 |
| 5,341,953 | A | | 8/1994 | Forester | |
| 5,384,139 | A | * | 1/1995 | Vasseneix | 426/128 |
| 5,496,575 | A | | 3/1996 | Newarski | |
| 5,514,394 | A | | 5/1996 | Lenahan | |
| 5,634,714 | A | * | 6/1997 | Guild | 366/130 |
| 5,676,275 | A | | 10/1997 | Khattar | |
| 5,927,538 | A | | 7/1999 | Collins | |
| D413,044 | S | | 8/1999 | Zappolo | |
| 6,105,812 | A | * | 8/2000 | Riordan | 220/504 |

(Continued)

OTHER PUBLICATIONS

Marvo, "Kellog's Frosted Flakes Drink 'n Crunch", http://www.theimpulsivebuy.com/wordpress/2006/04/02/kelloggs-frosted-flakes-drink-n-crunch/, Apr. 2, 2006.

(Continued)

*Primary Examiner* — Drew Becker
*Assistant Examiner* — Luana Z Long

(57) ABSTRACT

A system for facilitating a user's intake of edible substances. The system may include a first portion, a second portion, and a partition unit disposed between the first portion and the second portion. A first space may be located between the first portion and the partition unit for containing a first edible substance. A second space may be located between the second portion and the partition unit for containing a second edible substance. The system may also include a tube for causing a change at the partition unit to open an opening between the first space and the second space, and for transmitting a portion of an edible mixture to the mouth of the user. The edible mixture may include part of the first edible substance provided from the first space and part of the second edible substance provided from the second space.

39 Claims, 11 Drawing Sheets

U.S. PATENT DOCUMENTS

| | | | | |
|---|---|---|---|---|
| 6,209,718 | B1 * | 4/2001 | Mollstam et al. | 206/222 |
| 6,264,068 | B1 * | 7/2001 | Ours et al. | 222/129 |
| 6,502,714 | B1 * | 1/2003 | Lei | 220/709 |
| 6,598,762 | B2 * | 7/2003 | McKune | 222/82 |
| 6,913,777 | B2 | 7/2005 | Rebhorn | |
| 7,097,065 | B2 | 8/2006 | Yoneoka | |
| 7,147,880 | B2 | 12/2006 | Lenahan | |
| 7,591,388 | B2 * | 9/2009 | Amormino | 220/229 |
| 2003/0178433 | A1 * | 9/2003 | Adams | 220/703 |
| 2004/0007573 | A1 * | 1/2004 | Kang | 220/4.27 |
| 2005/0133505 | A1 | 6/2005 | Yoneoka | |
| 2005/0173554 | A1 | 8/2005 | Kuwagaki | |
| 2006/0045936 | A1 | 3/2006 | Shen | |
| 2006/0049207 | A1 | 3/2006 | Bogoshian | |
| 2006/0180483 | A1 | 8/2006 | Sekendur | |
| 2008/0264960 | A1 | 10/2008 | Phillips | |
| 2008/0286438 | A1 * | 11/2008 | Newell | 426/665 |
| 2009/0311389 | A1 * | 12/2009 | Zoss et al. | 426/120 |
| 2010/0200597 | A1 | 8/2010 | Light | |
| 2011/0210126 | A1 * | 9/2011 | Vovan | 220/574 |

OTHER PUBLICATIONS

Deissy Yamile Castiblanco Garcia, "Drink 'N Crunch", http://www.packagingdesignarchive.org/archive/pack__details/1460-drink-n-crunch, Oct. 6, 2009.

* cited by examiner

SYSTEMS AND METHODS FOR FACILITATING INTAKE OF EDIBLE SUBSTANCES

BACKGROUND OF THE INVENTION

The present invention is related to systems and methods for facilitating intake of edible substances. In particular, the present invention is related to systems and methods for facilitating intake of mixtures of edible substances. Examples of edible substances may include food, drink, health supplements, medicine, etc.

In various situations, it may be desirable to mix two or more edible substances immediately before the intake of the mixture of the edible substances, instead of pre-mix the edible substances long before the intake, for purposes such as optimizing the taste of the mixture and/or avoid shortening the time to expiration of the edible substances. For example, it may be desirable to mix cereal and milk right before the intake of the mixture, so that the cereal will not become too soggy; it may be desirable to mix instant noodle and water right before having the noodle soup; it may be desirable to mix cocktail ingredients right before serving; it may be desirable to mix baby formula and water right before feeding; etc.

Existing systems and methods for facilitating the intake of cereal and milk typically requires the use of a spoon. Requiring the use of the spoon, the existing systems and methods may cause spill of the cereal, the milk, and/or the mixture, and therefore may incur costs for cleaning and may cause waste of edible substances. The existing systems and methods may also be impractical for users who would like to have cereal and milk (for example, for breakfast) when they are on the move.

An existing system for facilitating the intake of cereal and milk eliminates the need for the spoon by providing a cereal outlet and a milk outlet disposed close to each other to enable the user to simultaneously pour cereal and milk into his or her mouth. Nevertheless, for enabling the cereal and the milk to flow into the user's mouth, this existing system may require the user to hold up the system and may require the user to face up for receiving the cereal and the milk. As a result, the system may make the user's arm and neck uncomfortable.

SUMMARY

An embodiment of the present invention is related to a system for facilitating a user's intake of edible substances. The user has a mouth. The system may include a first portion, a second portion, and a partition unit disposed between the first portion and the second portion. A first space may be located between the first portion and the partition unit for containing a first edible substance. A second space may be located between the second portion and the partition unit for containing a second edible substance that is different from the first edible substance. The system may also include a tube at least for causing a change at the partition unit to open an opening between the first space that contains the first edible substance and the second space that contains the second edible substance, and for transmitting at least a portion of an edible mixture from the second space to the mouth. The tube may have at least two holes. The edible mixture may include at least part of the first edible substance provided from the first space through the second space and at least part of the second edible substance provided from the second space.

The above summary relates to only one of the many embodiments of the invention disclosed herein and is not intended to limit the scope of the invention, which is set forth in the claims herein. These and other features of the present invention will be described in more detail below in the detailed description of the invention and in conjunction with the following figures.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

Figure 1A:
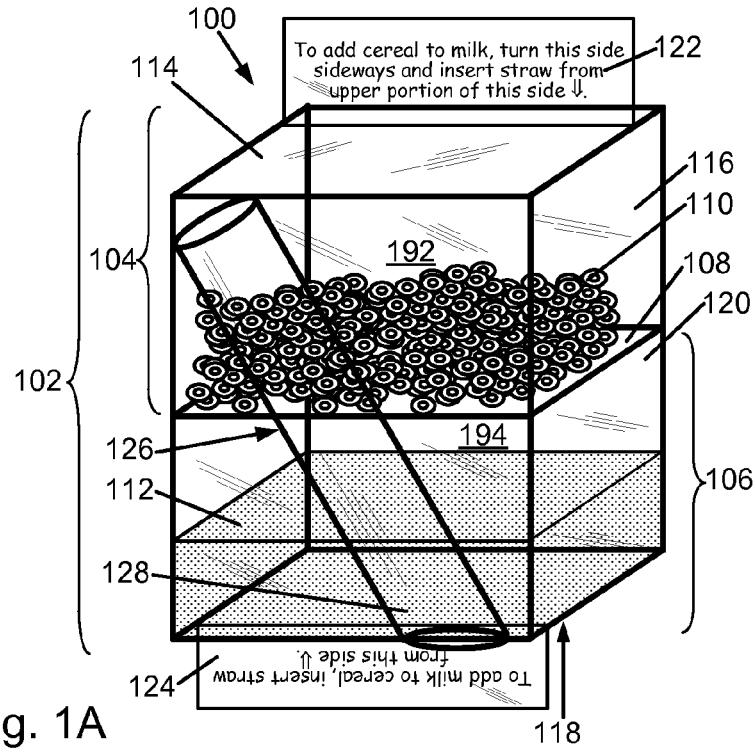
FIG. 1A shows a schematic representation illustrating a perspective view of a system for facilitating intake of edible substances (or "intake-facilitating system") in accordance with one or more embodiments of the present invention.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

One or more embodiments of the invention are related to a system for facilitating a user's intake of edible substances (or intake-facilitating system). The edible substances may include one or more solid edible substances and/or one or more fluid edible substances. For example, the edible substances may include one or more of cereal, milk, soy milk, instant noodle, instant soup mix, drink mix, water, soup, crackers, baby formula, cocktail ingredients, herbs, tea leaves, health supplement, fiber supplement, medicine, pet food, etc.

The user has a mouth for performing the intake. The system may be operated by the user. For example, an adult may operate the system to produce a mixture of edible substances and then consume the mixture. Additionally or alternatively, the system may be operated by a different operator for facilitating the intake performed by the user. For example, a parent may operate the system for facilitating a child's intake of edible substances; a care giver may operate the system for facilitating a patient's intake of edible substances; a pet owner may operate the system for facilitating a pet's intake of edible substances.

The system may include a first portion, a second portion, and a partition unit disposed between the first portion and the second portion. A first space (or first compartment) may be located or formed between the first portion and the partition unit for containing a first edible substance. A second space (or second compartment) may be located or formed between the second portion and the partition unit for containing a second edible substance that is different from the first edible substance.

The system may also include a tube, which has at least two holes, for performing a plurality of tasks. The plurality of tasks may include triggering the process of mixing of the edible substances, controlling the process of mixing of the edible substances, controlling the concentrations of the edible substances in the mixture of the edible substances, and transmitting the mixture of the edible substances.

The tube may cause a change at the partition unit to open an opening between the first space that contains the first edible substance and the second space that contains the second edible substance. The opening may enable the first edible substance to be added to the second edible substance and/or may enable the second edible substance to be added to the first edible substance.

In one or more embodiments, the system may include a flow rate control and concentration control mechanism that includes an end portion of the tube and a deformable (and resilient or elastic) member: disposing the end portion of the tube at a first position may deform the deformable member to a first extent to open the opening to a first size to cause a first flow rate of the first edible substance from the first space to the second space; disposing the end portion at a second position may deform the deformable member to a second extent to open the opening to a second size to cause a second flow rate of the first edible substance from the first space to the second space, the second position being lower than the first position, the second flow rate being greater than the first flow rate.

In one or more embodiments, the system may include a flow rate control and concentration control mechanism that includes an end portion of the tube, the partition unit, and the opening, wherein the end portion of the tube is asymmetric with respect to any plane parallel to the partition unit when the tube is disposed perpendicular to the partition unit: disposing the end portion partly inside the first space and partly inside the second space may cause a first flow rate of the first edible substance from the first space through the opening to the second space; disposing the end portion completely inside the first space may cause a second flow rate of the first edible substance from the first space through the first opening to the second space, the second flow rate being greater than the first flow rate.

The tube may also transmit at least a portion of an edible mixture from the second space to the mouth of the user, wherein the tube may operate as a straw. The edible mixture may include at least part of the first edible substance provided from the first space through the second space and at least part of the second edible substance provided from the second space.

Advantageously, embodiments of the invention may enable the user to utilize only one tool, the tube, to perform all of the above-mentioned triggering, control, and the transmission of the mixture. Embodiments of the invention may eliminate the need for a spoon to minimize spill, without requiring the user to maintain an uncomfortable posture.

In one or more embodiments, the system may include a mechanism enabling the user or the operator to choose between controlling the addition of the first edible substance into the second edible substance and controlling the addition of the second edible substance into the first edible substance. The mechanism may include a first designated portion disposed at the first portion for facilitating the insertion of the tube through the first portion and the first space into the second space for controlling a flow of the first edible substance from the first space to the second space. The mechanism may also include a second designated portion disposed at the second portion for facilitating the insertion of the tube through the second portion and the second space into the first space for controlling a flow of the second edible substance from the second space to the first space.

Adding the first edible substance into the second edible substance may be associated with a low initial concentration of the first edible substance and a high initial concentration of the second edible substance in the mixture. On the other hand, adding the second edible substance into the first edible substance may be associated with a low initial concentration of the second edible substance and a high initial concentration of the first edible substance in the mixture.

Advantageously, embodiments of the invention may enable the user to further easily control the process of mixing edible substances according to the user's preferences regarding concentrations of the edible substances in the mixture.

One or more embodiments of the invention are related to methods for facilitating intake of edible substance by, for example, providing, operating, and/or using the above-mentioned intake-facilitating system.

The features and advantages of the present invention may be better understood with reference to the figures and discussions that follow.

In the figures, some of the components are illustrated as transparent for facilitating discussion and understanding of embodiments of the invention. Nevertheless, the components may be translucent or opaque in one or more embodiments of the invention. In the examples discussed with reference to the figures, cereal and milk may be used as examples for edible substance. Nevertheless, one of more embodiments of the invention may operate with other edible substances.

FIG. 1A shows a schematic representation illustrating a perspective view of a system 100 for facilitating intake of edible substances (or "intake-facilitating system 100" or "system 100") in accordance with one or more embodiments of the present invention. As illustrated in the example of FIG. 1A, system 100 may include a container 102 that may include a portion 104, a portion 106, and a partition unit 108 disposed between portion 104 and portion 106. Each of portion 104, portion 106, and partition unit 108 may include well known food packaging, food container, beverage packaging, and/or beverage container materials, such as aluminum, paper, plastic (e.g., polyethylene), and/or stainless steel.

A space 192 (or compartment 192) may be located or formed inside portion 104, and/or located or formed between portion 104 and partition unit 108, for containing an edible substance 110, for example, cereal. A space 194 (or compartment 194) may be located or formed inside portion 106, and/or located or formed between portion 106 and partition unit 108, for containing an edible substance 112, for example, milk. In general, edible substance 112 may be different from edible substance 110. In one or more embodiments, each of space 192 and space 194 may contain solid and/or fluid edible substances.

In one or more embodiments, system 100 may include one or more temperature control units coupled with one or more of portion 104 and portion 106 for influencing and/or maintaining the temperature(s) of one or more of edible substance 110, edible substance 112, and a mixture of edible substance 110 and edible substance 112. The one or more temperature control units may include one or more of a heating unit (e.g., an electrical and/or chemical heating unit), a cooling unit (e.g., an electrical and/or chemical cooling unit), and an insulation unit.

System 100 may also include a tube 126 (or straw 126) at least for causing a change at partition unit 108 to open an opening between space 192 that contains edible substance 110 and space 194 that contains edible substance 112, and for operating as a straw to transmit at least a portion of an edible mixture from at least one of space 194 and space 192 to the mouth of a user. In one or more embodiments, the edible mixture may include at least part of edible substance 110 provided from space 192 through space 194 and at least part of edible substance 112 provided from space 194. In one or more embodiments, the edible mixture may include at least part of edible substance 112 provided from space 194 through space 192 and at least part of edible substance 110 provided from space 192.

Tube 126 may include or be made of a metal material (e.g., stainless steel) and/or a plastic material. Tube 126 may have at least two holes; one of the holes may be located at an end portion 128 of tube 126. In one or more embodiments, when not in use, tube 126 may be attached to at least an outer wall of at least one of portion 104 and portion 106 as illustrated in the example of FIG. 1A. In one or more embodiments, when not in use, tube 126 may be disposed in a bag or a case attached to at least an outer wall of at least one of portion 104 and portion 106. In one or more embodiments, at least one of portion 104 and portion 106 may include a holder for holding tube 126 when tube 126 is not in use. Although tube 126 is illustrated to have a straight configuration, tube 126 may include one or more other configurations, such as including one or more curved portions, in one or more embodiments.

System 100 may also include a choice-facilitating mechanism for enabling the user to choose between controlling the addition of edible substance 110 into edible substance 112 and controlling the addition of edible substance 112 into edible substance 110.

The choice-facilitating mechanism may include a designated portion 114 disposed at portion 104 for facilitating the insertion of tube 126 through portion 104 and space 192 into space 194 for controlling a flow of edible substance 110 from space 192 to space 194. The choice-facilitating mechanism may also include a designated portion 118 disposed at portion 106 for facilitating the insertion of tube 126 through portion 106 and space 194 into space 192 for controlling a flow of the second edible substance from space 194 to space 192.

In one or more embodiments, designated portion 114 may be made weaker, more fragile, and/or more penetrable than other part of portion 104, such as a side wall 116 of portion 104. In one or more embodiments, the constituents or material(s) of designated portion 114 may be different from the constituents or material(s) of side wall 116. In one or more embodiments, designated portion 114 may include fewer layers of materials than side wall 116. In one or more embodiments, at least part of designated portion 114 may be perforated. Analogously, designated portion 118 may be made weaker, more fragile, and/or more penetrable than other part of portion 106, such as a side wall 120 of portion 106.

Adding the edible substance 110 into edible substance 112 may be associated with a low initial concentration of edible substance 110 and a high initial concentration of edible substance 112 in the mixture. On the other hand, adding edible substance 112 into edible substance 110 may be associated with a low initial concentration of edible substance 112 and a high initial concentration of the substance 110 in the mixture.

Advantageously, embodiments of the invention may enable the user to easily control the process of mixing the edible substances according to the user's preferences regarding the concentrations of the edible substances in the mixture.

System 100 may include a communication element 122 disposed at portion 104 for indicating the location of designated portion 114. Communication element 122 may include a tab and/or a label disposed at portion 104. Communication element 122 may include text or symbols displayed at the tab, the label, and/or portion 104. Communication element 122 may instruct the user to insert tube 126 from portion 104 or designated portion 114 for controlling the amount of edible substance 110 (e.g., cereal) added into edible substance 112 (e.g., milk) or for adding edible substance 110 into edible substance 112. Analogously, system 100 may include a communication element 124 disposed at portion 106 for indicating the location of designated portion 118. Communication element 124 may instruct the user to insert tube 126 from portion 106 or designated portion 118 for controlling the amount of edible substance 112 (e.g., milk) added into edible substance 110 (e.g., cereal) or for adding edible substance 112 into edible substance 110.

In one or more embodiments, if edible substance 110 includes solid units (or if space 104 contains solid units), system 100 may provide instructions for instructing the user to rotate container 102 before inserting tube 126 from designated portion 114 (or from portion 104) and to insert tube 126 from an upper portion of designated portion 114 (or of portion 104). In one or more embodiments, the instructions may be provided at communication element 122.

Figure 1B:
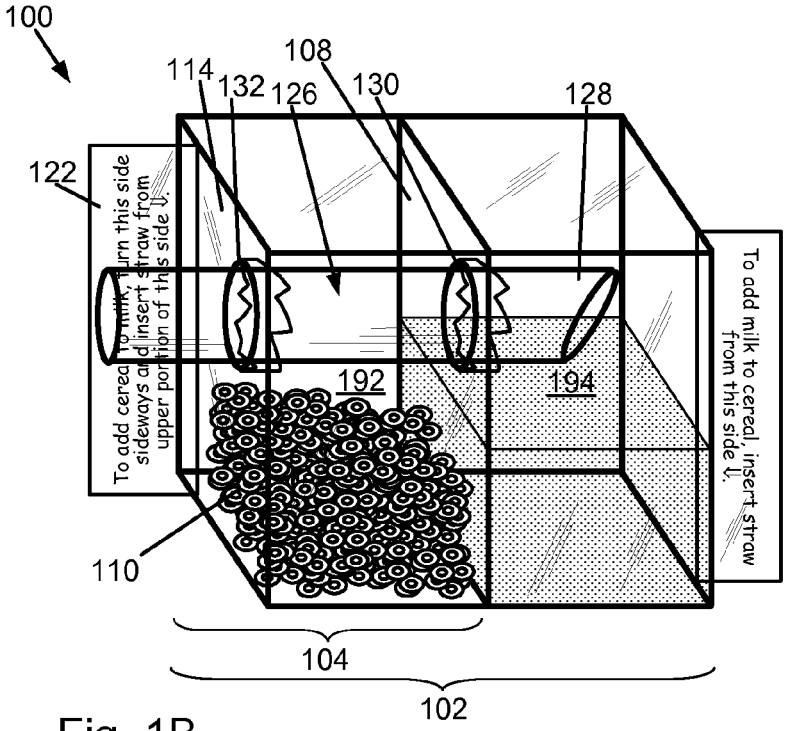
FIG. 1B shows a schematic representation illustrating a perspective view of the intake-facilitating system in accordance with one or more embodiments of the present invention.

FIG. 1B shows a schematic representation illustrating a perspective view of intake-facilitating system 100 in accordance with one or more embodiments of the present invention. As illustrated in the example of FIG. 1B, in accordance with instructions provided at communication element 122, container 102 may have been rotated to turn designated portion 114 sideways, and tube 126 may have been inserted from an upper portion of designated portion 114. Tube 126 may penetrate through portion 104, space 192, and partition unit 108 into space 194, creating an opening 132 at portion 104, creating an opening 130 at partition unit 108, and disposing end portion 128 inside space 194. In one or more embodiments, system 100 may provide instructions for instructing the user to put (or push) tube 126 through partition unit 108.

As can be appreciated from the example illustrated in the example of FIG. 1B, when container 102 has been rotated to turn designated portion 114 sideways, gravity may attract edible substance 110 towards the lower portion of space 192. Given that tube 126 is inserted from the upper portion of designated portion 114 through the upper portion of space 192, tube 126 may avoid at least some of edible substance 110, which may include solid units. Advantageously, embodiments of the invention may prevent tube 126 from being obstructed (or damaged) by at least some of the solid units and/or may prevent at least some the solid units from being broken by tube 126.

Figure 1C:
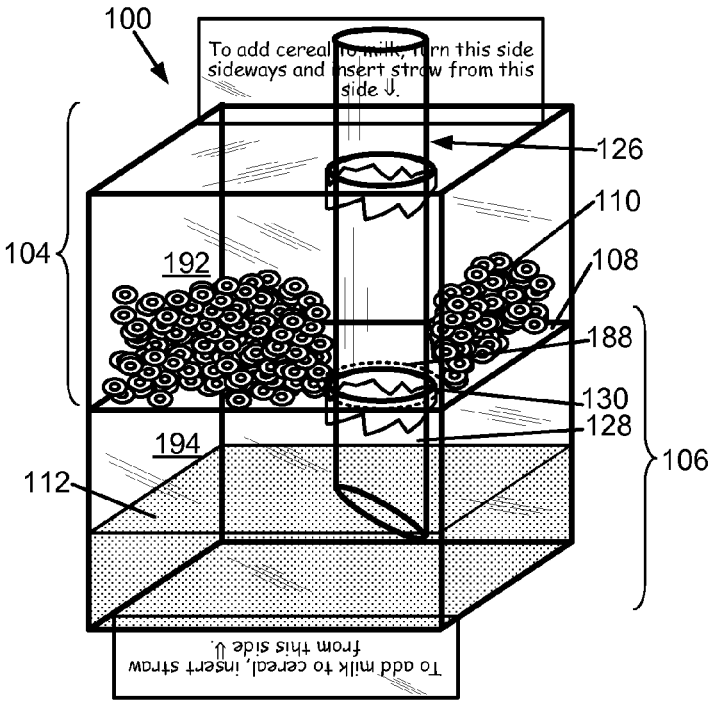
FIG. 1C shows a schematic representation illustrating a perspective view of the intake-facilitating system in accordance with one or more embodiments of the present invention.
Figure 1D:
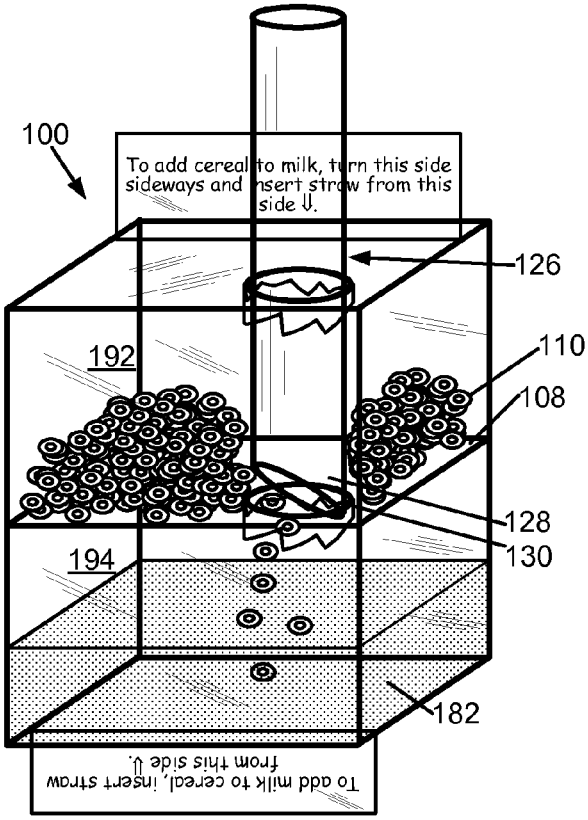
FIG. 1D shows a schematic representation illustrating a perspective view of the intake-facilitating system in accordance with one or more embodiments of the present invention.
Figure 1E:
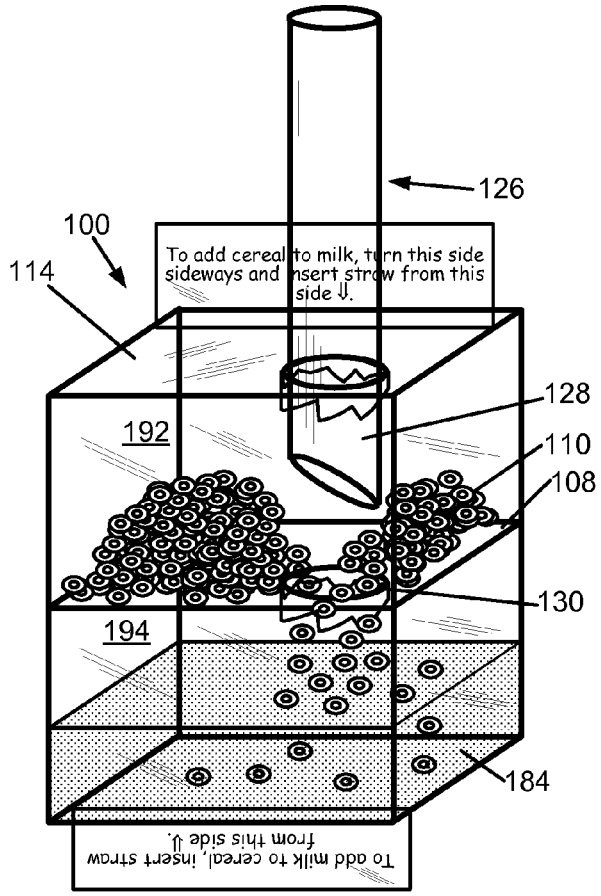
FIG. 1E shows a schematic representation illustrating a perspective view of the intake-facilitating system in accordance with one or more embodiments of the present invention.

FIG. 1C, FIG. 1D, FIG. 1E show schematic representations illustrating perspective views of intake-facilitating system 100 in accordance with one or more embodiments of the present invention. FIG. 1C, FIG. 1D, and FIG. 1E illustrate that system 100 may include a flow rate control mechanism that may include tube 126, partition unit, and opening 130.

As illustrated in the example of FIG. 1C, as part of the flow rate control mechanism of system 100, tube 126 may block or reduce the flow (or movement) of edible substance 110 from space 192 through opening 130 to space 194 (and into edible substance 112 or an edible mixture) when end portion 128 is disposed inside space 194 and when tube 126 is disposed through opening 130.

FIG. 1C also illustrates that partition unit 108 may includes a region 188 (indicated by a dotted outline) disposed under tube 126 and disposed between portion 104 and portion 106 for receiving a push from tube 126 to open the opening.

As illustrated in the example of FIG. 1D, end portion 128 of tube 126 may be asymmetric with respect to any plane parallel to partition unit 108 when tube 126 is disposed perpendicular to partition unit 108. As further illustrated in the example of FIG. 1D, disposing end portion 128 partly inside space 192 and partly inside space 194 may cause a first flow rate of edible substance 110 from space 192 through opening 130 to space 194. The first flow rate may affect the speed of adding edible substance 110 into edible substance 112 (illustrated in one or more of the examples of FIG. 1A-FIG. 1C) or into an edible mixture 182 that already contains some of edible substance 110 and some of edible substance 112.

As illustrated in the example of FIG. 1E, disposing end portion 128 completely inside space 192 may allowing at least a portion of edible substance 110 to move from space 192 through opening 130 to space 194, causing a second flow rate of edible substance 110 from space 192 through opening 130 to space 194. The second flow rate may affect the speed of adding edible substance 110 into edible substance 112 (illustrated in one of more of the examples of FIG. 1A-FIG. 1C) or into an edible mixture 184 that already contains some of edible substance 110 and some of edible substance 112. The second flow rate may be greater than the first flow rate.

Figure 1F:
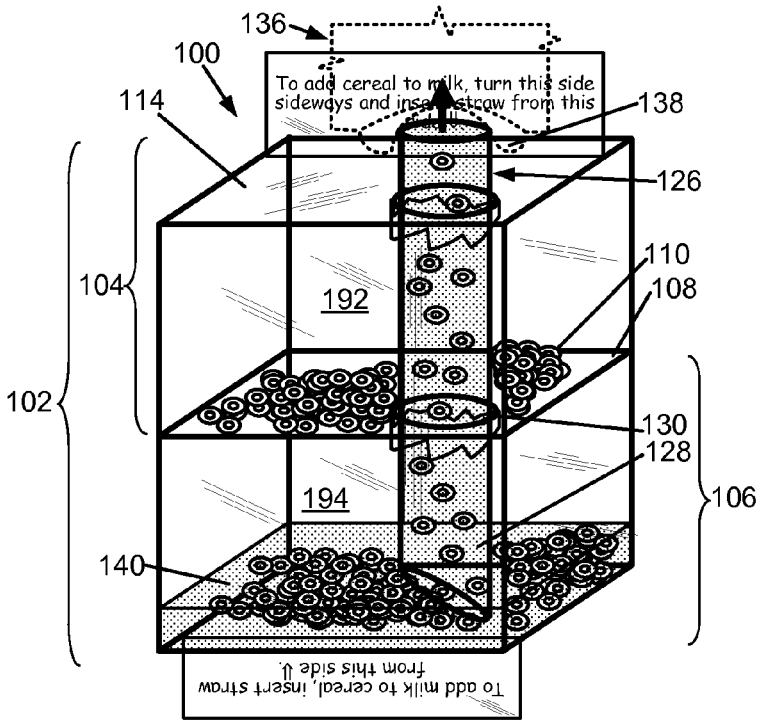
FIG. 1F shows a schematic representation illustrating a perspective view of the intake-facilitating system in accordance with one or more embodiments of the present invention.

FIG. 1F shows a schematic representation illustrating a perspective view of intake-facilitating system 100 in accordance with one or more embodiments of the present invention. As illustrated in the example of FIG. 1F, tube 126 may operate as a straw to transmit at least a portion of an edible mixture 140 from space 194 to the mouth 138 of a user 136 when end portion 128 is disposed inside space 194 and when tube 126 is disposed through portion 104, first space 192, and opening 130. Edible mixture 140 may include at least part of edible substance 110 provided from space 192 through space 194 and at least part of edible substance 112 provided from space 194. The portion of edible mixture 140 may travel through end portion 128, opening 130, partition unit 108, space 192, and portion 104 before reaching mouth 138 of user 136. Tube 126 may be repositioned upwards to dispose end portion 128 partly inside space 192 and partly inside space 194 (as illustrated in the example of FIG. 1D) or to dispose end portion 128 completely inside space 192 for adding more of edible substance 110 into edible mixture 140 to adjust the concentrations of edible substance 110 and edible substance 112 in edible mixture 140.

As can be appreciated from the discussion provided above with reference to the examples of FIG. 1C, FIG. 1D, FIG. 1E, and FIG. 1F, embodiments of the invention may enable the user to perform all of triggering (or starting) the process of mixing of edible substances, controlling the process of mixing of the edible substances, controlling the concentrations of the edible substances in the mixture of the edible substances, and transmitting the mixture of the edible substances utilizing only one tool, tube 126. Advantageously, the intake of the mixture of the edible substances may be performed in a convenient manner. Tube 126 may also produce substantially less spill than potential spill that may be produced by a spoon in a prior art system.

Figure 1G:
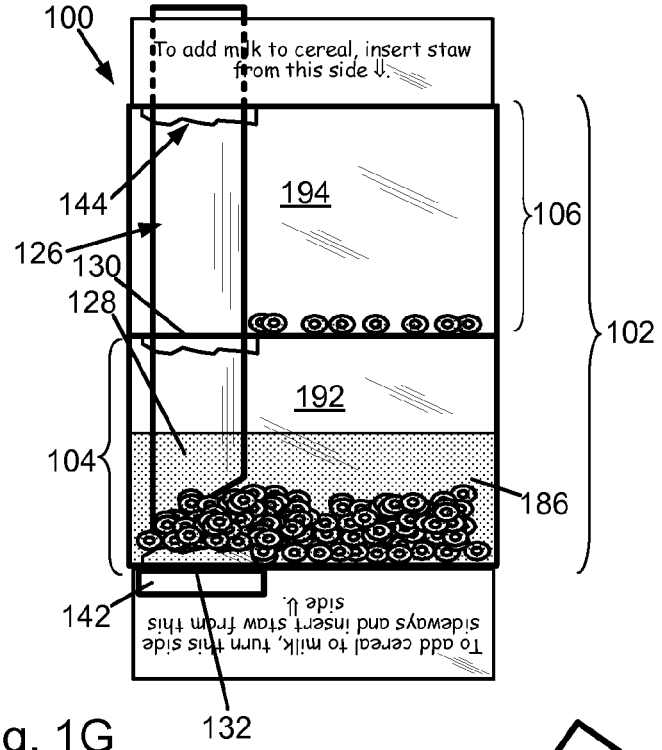
FIG. 1G shows a schematic representation illustrating a perspective view of the intake-facilitating system in accordance with one or more embodiments of the present invention.

FIG. 1G shows a schematic representation illustrating a front view of intake-facilitating system 100 in accordance with one or more embodiments of the present invention. As illustrated in the example of FIG. 1G, system 100 may include a closure unit 142, such as a valve, a cap, a lid, or a plug, for closing or covering opening 132. After opening 132 has been closed or covered, container 102 may be flipped to dispose space 194 above space 192 (or to dispose portion 106 above portion 104) to accelerate the mixing process assuming edible substance 112 (illustrated in one or more of the examples of FIG. 1A-FIG. 1C) or the edible mixture in space 194 (such as edible mixture 182 illustrated in the example of FIG. 1D, edible mixture 184 illustrated in the example of FIG. 1E, or edible mixture 140 illustrated in the example of FIG. 1F) includes more liquid than edible substance 110 (illustrated in one or more of the examples of FIG. 1A-FIG. 1F) and flows faster than edible substance edible substance 110. After opening 132 has been closed or covered, and after container 102 has been flipped, tube 126 may be inserted through an opening 144 at portion 106 and through opening 130 to dispose end portion 128 in space 192 for transmitting edible mixture to the mouth of the user.

As can be appreciated from the discussion provided with reference to the example of FIG. 1G, closure unit 142 may provide further flexibility and controllability for the user to control the mixing process.

Figure 1H:
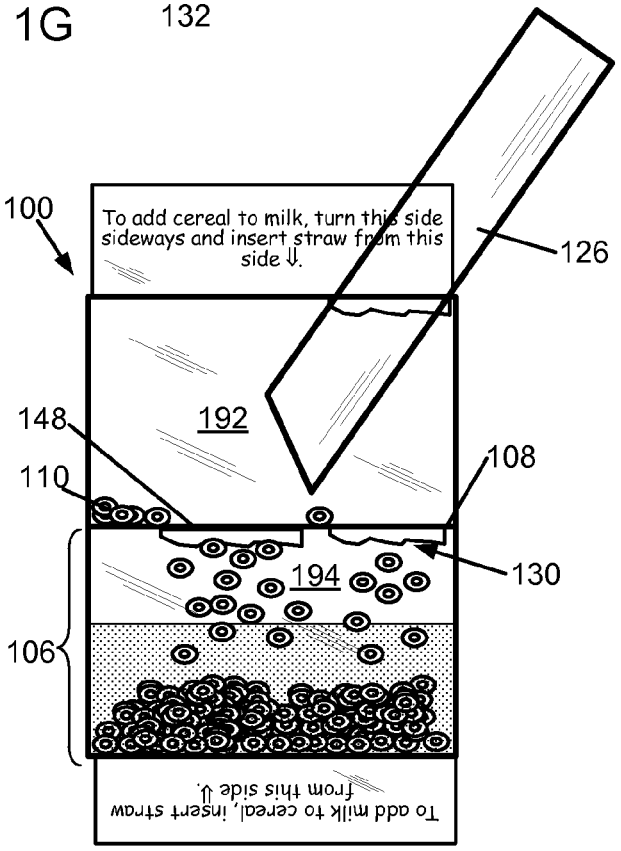
FIG. 1H shows a schematic representation illustrating a perspective view of the intake-facilitating system in accordance with one or more embodiments of the present invention.

FIG. 1H shows a schematic representation illustrating a front view of intake-facilitating system 100 in accordance with one or more embodiments of the present invention. In one or more embodiments, tube 126 may be pushed partition unit 108 to form an additional opening 148 (in addition to opening 130) between space 192 and space 194 for generating an additional flow of edible substance 110 from space 194 to space 192. As illustrated in the example of FIG. 1H, after tube 126 has been moved away from opening 148, both opening 148 and opening 130 allow edible substance 110 to flow from space 194 to space 192.

As can be appreciated from the discussion provided with reference to the example of FIG. 1H, partition unit 108 and tube 126 may provide further flexibility and controllability for the user to control the mixing process.

Figure 2A:
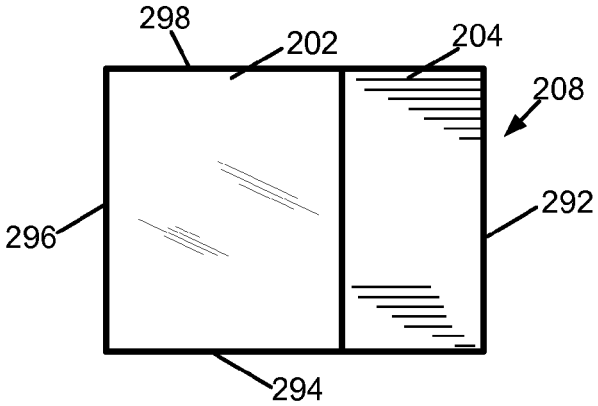
FIG. 2A shows a schematic representation illustrating a top view of a partition unit for use in an intake-facilitating system in accordance with one or more embodiments of the present invention.

FIG. 2A shows a schematic representation illustrating a top view of a partition unit 208 for use in an intake-facilitating system in accordance with one or more embodiments of the present invention. In one or embodiments, one or more of edge 292, edge 294, edge 296, and edge 298 of partition unit 208 that are coupled with other portions of the intake-facilitating system may break away from the other portions of the intake-facilitating system when partition unit 208 receives a force greater than a threshold such that partition unit 208 may collapse to form an opening between one or more of edge 292, edge 294, edge 296, and edge 298 and other portion of the intake-facilitating system. For example, the intake-facilitating system may be weakened and/or perforated near or at edge 292, edge 294, edge 296, and edge 298.

In one or more embodiments, partition unit 208 may be a deformable member that is bendable. In one or more embodiments, partition unit 208 may include one or more resilient materials, such as rubber, elastic plastic, and/or silicone.

In one or more embodiments, partition unit 208 may include a reinforced portion 204 for receiving a force provided by a tube (similar to tube 126 illustrated in the examples of FIG. 1A-FIG. 1H) of the intake-facilitating system to the force receiving point of prevent partition unit 208 from being penetrated by the tube. Reinforced portion 204 may be more rigid than another portion of partition unit 208, such as portion 202. In one or more embodiments, the constituents or material(s) of reinforced portion 204 may be different from the constituents or material(s) of portion 202. In one or more embodiments, reinforced portion 204 may include a metal. In one or more embodiments, reinforced portion 204 may include more layers of materials than portion 202.

Figure 2B:
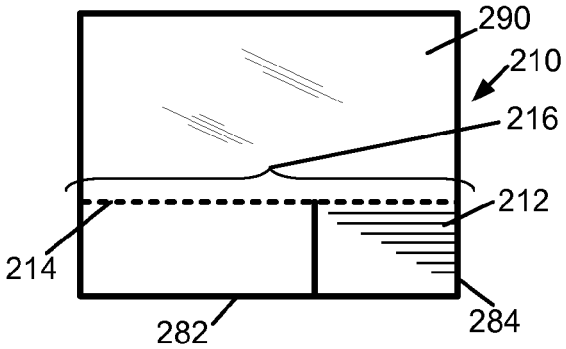
FIG. 2B shows a schematic representation illustrating a top view of a partition unit for use in an intake-facilitating system in accordance with one or more embodiments of the present invention.

FIG. 2B shows a schematic representation illustrating a top view of a partition unit 210 for use in an intake-facilitating system in accordance with one or more embodiments of the present invention. Partition unit 210 may include a deformable member 216 located along a side of partition unit 210. Deformable member 216 may be collapsible bendable, and/or flexible.

In one or embodiments, when deformable member 216 receives a force (from a tube of the intake-facilitating system) that is greater than a threshold, one or more edges (such as edge 282 and/or edge 284) of partition unit 210 may break away from other portions of the intake-facilitating system, and deformable member 216 may break away from another portion 290 of partition unit 210 at edge 214. As a result, at least an opening may be formed at the break spots.

In one or more embodiments, deformable member 216 may include one or more resilient materials, such as rubber, elastic plastic, and/or silicone.

In one or more embodiments, deformable member 216 may include a reinforced portion 212 for receiving a force provided by the tube of the intake-facilitating system.

Figure 2C:
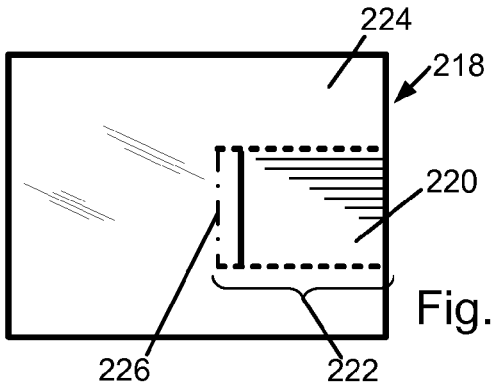
FIG. 2C shows a schematic representation illustrating a top view of a partition unit for use in an intake-facilitating system in accordance with one or more embodiments of the present invention.

FIG. 2C shows a schematic representation illustrating a top view of a partition unit 218 for use in an intake-facilitating system in accordance with one or more embodiments of the present invention. Partition unit 218 may include a deformable member 222 located at an edge of partition unit 218. Deformable member 222 may be collapsible bendable, and/or flexible. Deformable member 222 may include a reinforced portion 220 for receiving a force provided by a tube of the intake-facilitating system. Deformable member 222 may remain connected to the other portion 224 of partition unit 218 through edge 226 when deformable member 222 is deformed by the tube of the intake-facilitating system.

Figure 2D:
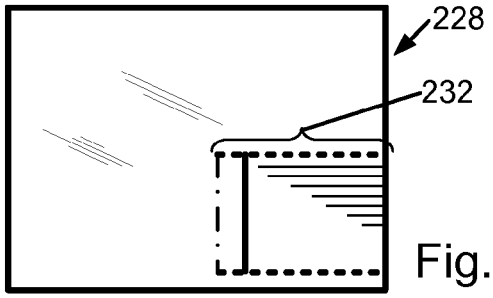
FIG. 2D shows a schematic representation illustrating a top view of a partition unit for use in an intake-facilitating system in accordance with one or more embodiments of the present invention.

FIG. 2D shows a schematic representation illustrating a top view of a partition unit 228 for use in an intake-facilitating system in accordance with one or more embodiments of the present invention. Partition unit 228 may include a deformable member 232 located at a corner of partition unit 228. Deformable member 232 may have features that are similar to features of deformable member 222 discussed in the example of FIG. 2C.

Figure 2E:
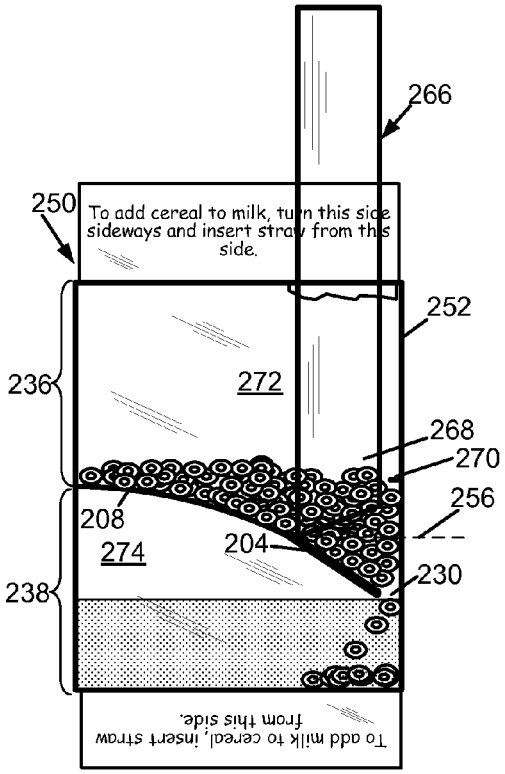
FIG. 2E shows a schematic representation illustrating a front view of an intake-facilitating system in accordance with one or more embodiments of the present invention.

FIG. 2E shows a schematic representation illustrating a front view of an intake-facilitating system 250 (or "system 250") in accordance with one or more embodiments of the present invention.

System 250 may include a container 252. Container 252 may include well known food packaging, food container, beverage packaging, and/or beverage container materials, such as aluminum, paper, and/or plastic (e.g., polyethylene).

System 250 may also include partition unit 208 illustrated in the example of FIG. 2A. In one or more embodiments, system 250 may include one or more of partition unit 210, partition unit 218, and partition unit 228 illustrated in the examples of FIG. 2B-FIG. 2D to provide features similar to features provided by partition unit 208. Partition unit 208 may be disposed inside container 252 and disposed between an upper portion 236 and a lower portion 238 of container 252. Partition unit 208 may divide the space inside container 252 into a space 272 and a space 274. The sizes of space 272 and space 274 may change when partition unit 208 is deformed. Space 272 may contain a first edible substance, for example, cereal. Space 274 may contain a second edible substance, for example, milk. In general, the first edible substance may be different from the second edible substance. In one or more embodiments, each of space 272 and space 274 may contain solid and/or fluid edible substances.

In one or more embodiments, system 250 may include one or more temperature control units coupled with container 252 for influencing and/or maintaining the temperature(s) of one or more of the first edible substance, the second edible substance, and a mixture of the first edible substance and the second edible substance. The one or more temperature control units may include one or more of a heating unit (e.g., an electrical and/or chemical heating unit), a cooling unit (e.g., an electrical and/or chemical cooling unit), and an insulation unit.

System 250 may also include a tube 266 (or straw 266) at least for causing a change at partition unit 208 to open an opening (such as an opening having a size 230) between space 272 that contains the first edible substance and space 274 that contains the second edible substance, and for operating as a straw to transmit at least a portion of an edible mixture from at least one of space 274 and space 272 to the mouth of a user. Partition member 208 (being a deformable member or including a deformable member) may be disposed under tube 266 and disposed between portion 236 and portion 238 for receiving a push from tube 266 to open the opening. The edible mixture may include at least part of the first edible substance provided from space 272 through space 274 and at least part of the second edible substance provided from space 274. In one or more embodiments, the edible mixture may include at least part of the second edible substance provided from space 274 through space 272 and at least part of the first edible substance provided from space 272.

Tube 266 may include a metal material (e.g., stainless steel) and/or a plastic material. Tube 266 may have at least two holes; one of the holes may be located at an end portion 268 of tube 266. Although tube 266 is illustrated to have a straight configuration, tube 266 may include one or more other configurations, such as including one or more curved portions, in one or more embodiments.

Figure 2G:
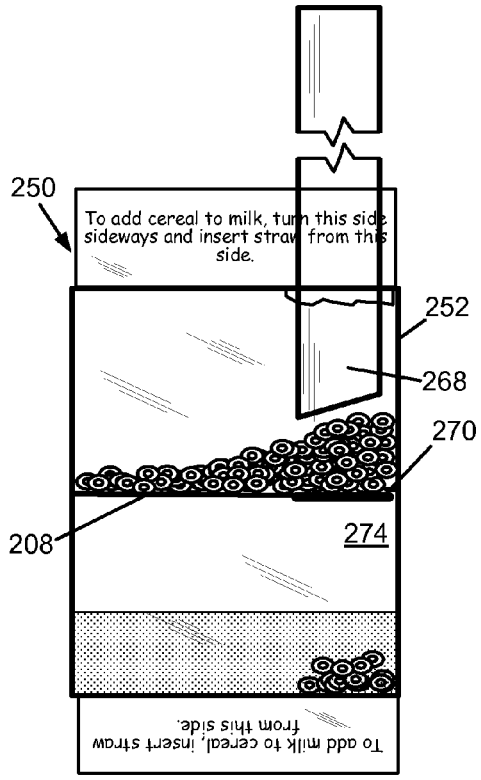
FIG. 2G shows a schematic representation illustrating a front view of the intake-facilitating system in accordance with one or more embodiments of the present invention.
Figure 2F:
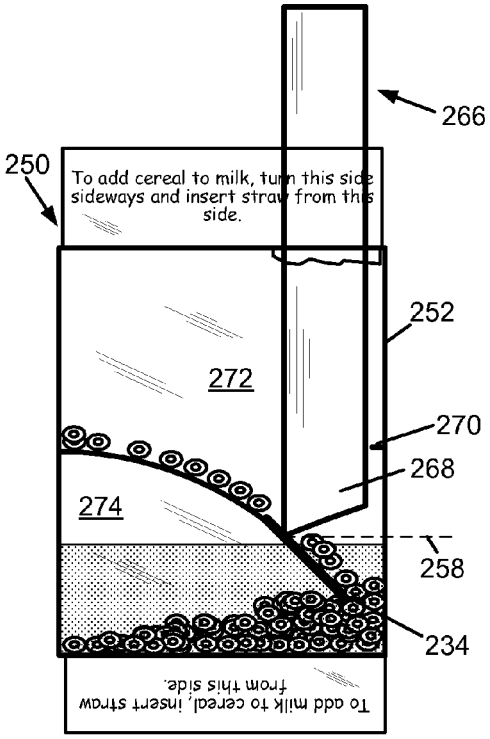
FIG. 2F shows a schematic representation illustrating a front view of the intake-facilitating system in accordance with one or more embodiments of the present invention.

FIG. 2E, FIG. 2F, and FIG. 2G illustrate that system 250 may include a flow rate control mechanism that may include end portion 268 of tube 266 and partition unit 208, a deformable member. In one or more embodiments, the flow rate control mechanism of system 250 may include one or more of deformable member 216, deformable member 222, and deformable member 232 illustrated in the examples of FIG. 2B-FIG. 2D. The one or more of deformable member 216, deformable member 222, and deformable member 232 may be disposed under tube 266 and disposed between portion 236 and portion 238 for receiving a push from tube 266 to open the opening.

Before tube 266 pushes partition unit 208, there may be no opening between space 272 and space. When tube 266 pushes partition unit, reinforced portion 204 may receive the force provided by tube 266 to prevent the force-receiving point of partition unit 208 from being penetrated by tube 266. When the force provided by tube 266 is greater than a threshold, partition unit 208 (or the deformable member) may be deformed, and an opening may be opened between space 272 and space 274.

As illustrated in the example of FIG. 2E, disposing end portion 268 at position 256 may deform partition unit 208 (or the deformable member) to a first extent to open the opening to a first size 230 to cause a first flow rate of the first edible substance from space 272 to space 274.

As illustrated in the example of FIG. 2F, disposing end portion 268 at position 258 may deform partition unit 208 (or the deformable member) to a second extent to open the opening to a first size 230 to cause a first flow rate of the first edible substance from space 272 to space 274. Position 258 may be lower than position 256, and the second flow rate may be greater than the first flow rate.

In one or more embodiment, partition unit 208 may include or be made of at least a resilient material. As illustrated in the example of FIG. 2G, when end portion 268 is moved away from partition unit 208 (or the deformable member), partition unit 208 (or the deformable member) may return to some extent and may close at least a portion of the opening.

As further illustrated in the examples of FIG. 2E-FIG. 2G, in one or more embodiments, system 250 may also include at least one protrusion, such as protrusion 270, coupled to the inner wall of container 252 (or at least one inner wall of at least one of the upper portion and the lower portion of container 252. The protrusion(s) may secure partition unit 208 (or the deformable member) in place before the opening is opened (or before secure partition unit 208 is deformed). For example, an edge of partition unit 208 (or the deformable member) may be attached to the protrusion(s). After the opening has been opened, the opening may be located between the protrusion(s) and partition unit 208 (or the deformable member), and tube 266 also may be located between the protrusion(s) and partition unit 208 (or the deformable member). When tube 266 is moved away from partition unit 208 (or the deformable member) and when partition unit 208 (or the deformable member) returns to some extent, the protrusion(s) may compensate for the deformation of partition unit 208 (or the deformable member) and may block at least some of the first edible substance from entering space 274, as illustrated in the example of FIG. 2G.

Figure 2H:
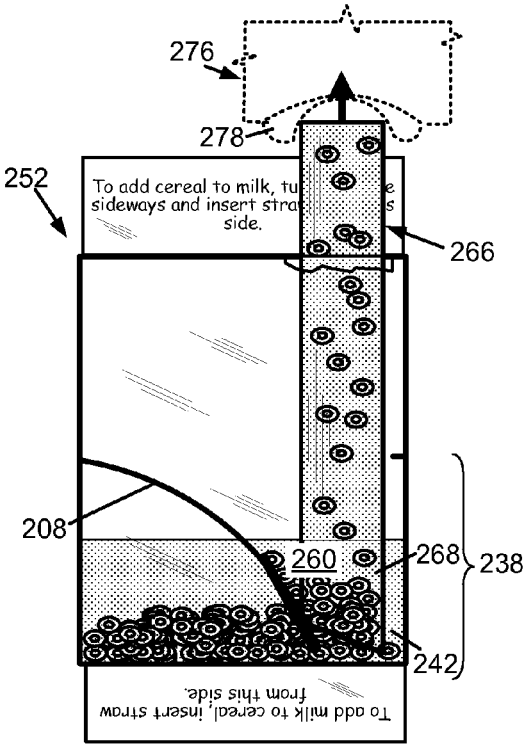
FIG. 2H shows a schematic representation illustrating a front view of the intake-facilitating system in accordance with one or more embodiments of the present invention.

FIG. 2H shows a schematic representation illustrating a front view of the intake-facilitating system 252 in accordance with one or more embodiments of the present invention. As illustrated in the example of FIG. 2H, tube 266 may operate as a straw to transmit at least a portion of an edible mixture 242 to the mouth 278 of a user 276 when end portion 128 is submerged in edible mixture 242. Edible mixture 242 may include at least part of the first edible substance provided from space 272 and at least part of the second edible substance provided from space 274.

In one or more embodiments, a region 260 may be formed between partition unit 208 and second portion 238, with end portion 268 of tube 266 being disposed inside region 266. At least a portion of the first edible substance and a portion of the second edible substance may be mixed inside the region.

As can be appreciated from the discussion provided above with reference to the examples of FIG. 2E, FIG. 2F, FIG. 2G, and FIG. 2H, embodiments of the invention may enable the user to perform all of triggering (or starting) the process of mixing of edible substances, controlling the process of mixing of the edible substances, controlling the concentrations of the edible substances in the mixture of the edible substances, and transmitting the mixture of the edible substances utilizing only one tool, tube 266. Advantageously, the intake of the mixture of the edible substances may be performed in a convenient manner. Tube 266 may also produce substantially less spill than potential spill that may be produced by a spoon in a prior art system.

Figure 3:
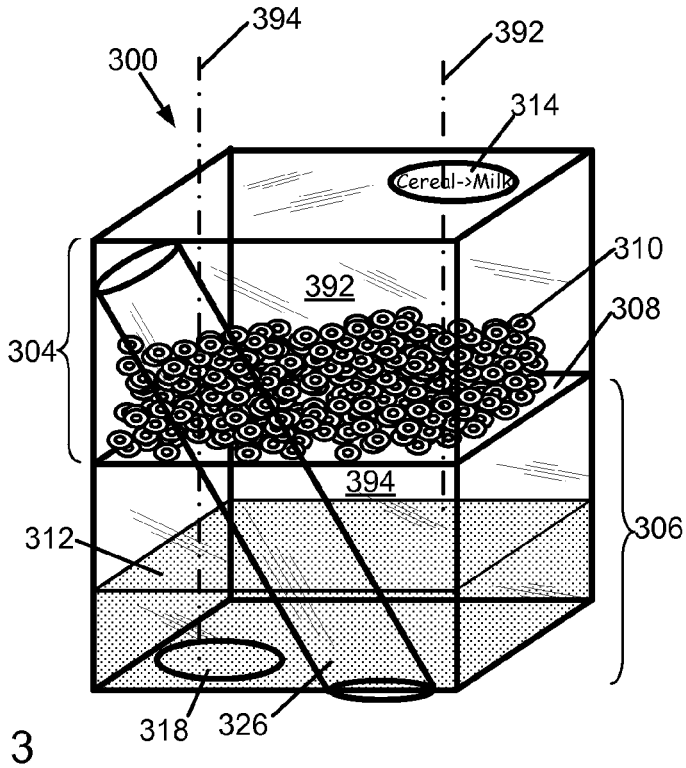
FIG. 3 shows a schematic representation illustrating a perspective view of an intake-facilitating system in accordance with one or more embodiments of the present invention.

FIG. 3 shows a schematic representation illustrating a perspective view of an intake-facilitating system 300 (or "system 300") in accordance with one or more embodiments of the present invention. System 300 may also include a choice-facilitating mechanism for enabling the user to choose between controlling the addition of edible substance 310 into edible substance 312 and controlling the addition of edible substance 312 into edible substance 310.

The choice-facilitating mechanism may include a designated portion 314 disposed at portion 304 (on a first side of partition unit 308) for facilitating the insertion of tube 326 through portion 304 and space 392 into space 394 for controlling a flow of edible substance 310 from space 392 to space 394.

The choice-facilitating mechanism may also include a designated portion 318 disposed at portion 306 (on a second side of partition unit 308) for facilitating the insertion of tube 326 through portion 306 and space 394 into space 392 for controlling a flow of the second edible substance from space 394 to space 392.

In one or more embodiments, designated portion 314 may be made weaker, more fragile, and/or more penetrable than other part of portion 304. Analogously, designated portion 318 may be made weaker, more fragile, and/or more penetrable than other part of portion 306.

In one or more embodiments, designated portion 314 and designated portion 318 may be disposed with misalignment, for preventing tube 326 from penetrating both designated portion 314 and designated portion 318. With the misalignment, an imaginary straight line 329 that is perpendicular to partition unit 308 and passes through designated portion 314 may be parallel to an imaginary straight line that is perpendicular to partition unit 308 and passes through designated portion 318.

Advantageously, embodiments of the invention may enable the user to easily control the process of mixing the edible substances according to the user's preferences regarding the concentrations of the edible substances in the mixture, while reducing the risk of leakage.

Figure 4:
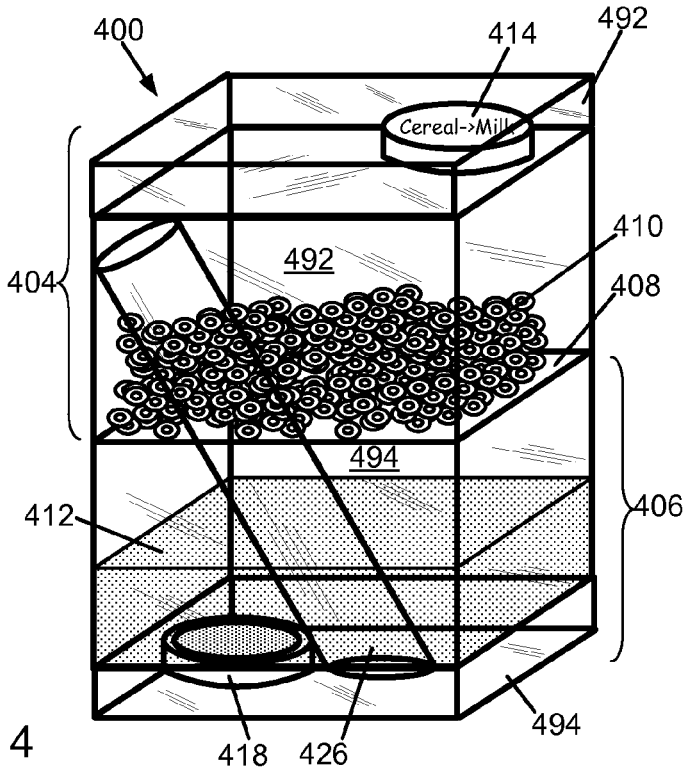
FIG. 4 shows a schematic representation illustrating a perspective view of an intake-facilitating system in accordance with one or more embodiments of the present invention.

FIG. 4 shows a schematic representation illustrating a perspective view of an intake-facilitating system 400 (or "system 400") in accordance with one or more embodiments of the present invention.

System 400 may include a first designated portion disposed at portion 404 (on a first side of partition unit 408) for facilitating the insertion of tube 426 through portion 404 and space 492 into space 494 for controlling a flow of edible substance 410 from space 492 to space 494.

System 400 may also include a second designated portion disposed at portion 406 (on a second side of partition unit 408) for facilitating the insertion of tube 426 through portion 406 and space 494 into space 492 for controlling a flow of the second edible substance from space 494 to space 492.

System 400 may also include a closure unit 414 (such as a valve, a cap, a lid, or a plug) disposed at portion 404 for covering an opening located at the first designated portion (after tube 426 has penetrated the first designated portion).

System 400 may also include a closure unit 418 (such as a valve, a cap, a lid, or a plug) disposed at portion 406 for covering an opening located at the second designated portion (after tube 426 has penetrated the second designated portion).

System 400 may also include structure 492 coupled with portion 404 and surrounding closure unit 414. Structure 492 and portion 404 may form a first container when portion 404 is disposed under structure 492. The first container may collect spill coming from an opening located at the first designated portion. In addition, structure 492 may support system 400 when structure 492 is disposed under portion 404.

System 400 may also include structure 494 coupled with portion 406 and surrounding closure unit 418. Structure 494 and portion 406 may form a second container when portion 406 is disposed under structure 494. The second container may collect spill coming from an opening located at the second designated portion. In addition, structure 494 may support system 400 when structure 494 is disposed under portion 406.

Advantageously, embodiments of the invention may enable the user to easily control the process of mixing the edible substances according to the user's preferences regarding the concentrations of the edible substances in the mixture, while reducing the risk of leakage and the risk of spill out of intake-facilitating systems.

Figure 5A:
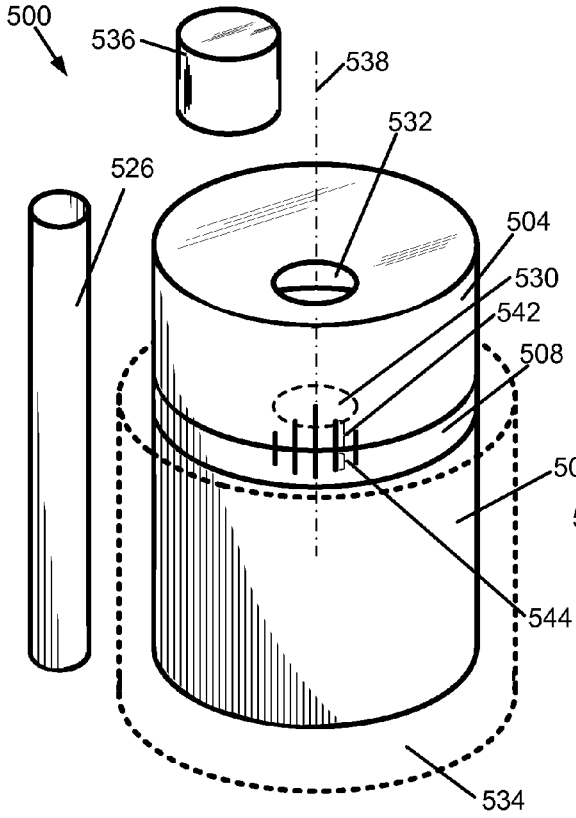
FIG. 5A shows a schematic representation illustrating a perspective view of an intake-facilitating system in accordance with one or more embodiments of the present invention.
Figure 5B:
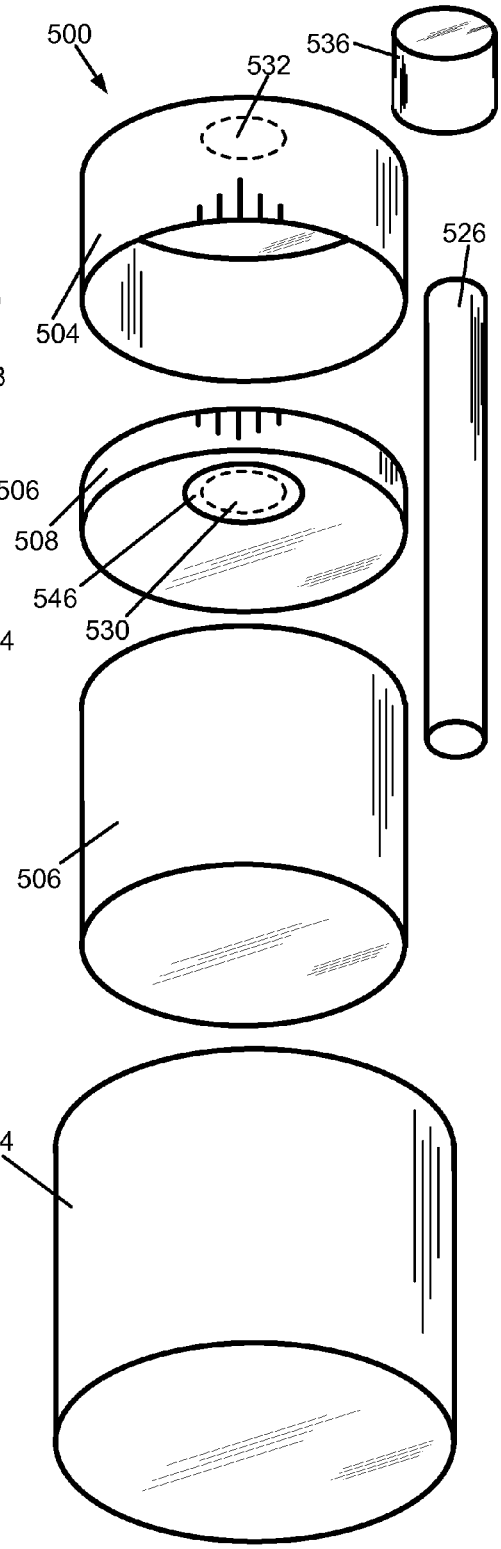
FIG. 5B shows a schematic representation illustrating an exploded view of the intake-facilitating system in accordance with one or more embodiments of the present invention.

FIG. 5A shows a schematic representation illustrating a perspective view of an intake-facilitating system 500 (or "system 500") in accordance with one or more embodiments of the present invention. FIG. 5B shows a schematic representation illustrating an exploded view of intake-facilitating system 500 in accordance with one or more embodiments of the present invention. System 500 may include a portion 504, a portion 506, and a partition unit 508 coupled between portion 504 and portion 506. Each of portion 504, portion 506, and partition unit 508 may include well known food packaging, food container, beverage packaging, and/or beverage container materials, such as aluminum, paper, plastic (e.g., polyethylene), and/or stainless steel.

A first space (or first compartment) may be located inside portion 504, and/or located between portion 504 and partition unit 508, for containing a first edible substance, for example, cereal or milk. A second space (or second compartment) may be located inside portion 506, and/or located or formed between portion 506 and partition unit 508, for containing a second edible substance, for example, milk or cereal, and for containing a mixture of at least a portion of the first edible substance and at least a portion of the second edible substance. In general, the second edible substance may be different from the first edible substance. Each of the first space and the second space may contain solid and/or fluid edible substances. In one or more embodiments, the second space may be larger than the first space for containing the mixture of the first edible substance and the second edible substance.

System 500 may also include a tube 526 (or straw 526) at least for moving a closure unit 546 disposed at partition unit 508 to open an opening 530 between the first space that contains the first edible substance and the second space that contains the second edible substance, and for operating as a straw to transmit at least a portion of an edible mixture from the second space to the mouth of a user. Tube 526 may go through an opening 532 located at portion 504 for moving closure unit 546. The edible mixture may include at least part of the first edible substance provided from the first space through the second space and at least part of the second edible substance provided from the second space. In one or more embodiments, the edible mixture may include at least part of the second edible substance provided from the second space through the first space and at least part of the first edible substance provided from the first space.

Closure unit 546 may be a reusable closure unit, such as a lid, a cap, or a plug. Closure unit 546 may be connected to partition unit 508 for closing opening 530. Closure unit 546 may be disposed inside the second space. At least a portion of opening 530 may be located between closure unit 546 and the first space.

System 500 may also include a cap 536 for closing or covering opening 532 located at portion 504. Cap 536 may also cover tube 526 after use of system 500.

System 500 may include one or more temperature control units coupled with one or more of portion 504 and portion 506 for influencing and/or maintaining the temperature(s) of one or more of the edible substance, the second edible substance, and the mixture of the first edible substance 110 and the second edible substance. The one or more temperature control units may include one or more of a heating unit (e.g., an electrical and/or chemical heating unit), a cooling unit (e.g., an electrical and/or chemical cooling unit), and an insulation unit. In one or more embodiments, system 500 may include a chemically heated unit 534 coupled with and/or surrounding portion 506.

System 500 may also include an alignment mechanism. For example, the alignment mechanism may include at least one feature 544 (or mark 544) disposed at partition unit 508 and at least one feature 542 (or mark 543) disposed at portion 504. Opening 530 may align with opening 532 (such that an imaginary line 538 perpendicular with partition unit 508 passes through both opening 530 and opening 532 when feature 544 matches feature 542. In one or more embodiments, the alignment mechanism may include an audio or tactile feedback mechanism, such as a mechanism including a spring-biased ball (or a spring-biased pin) protruding from a mating surface and an indentation, wherein the mechanism may provide a "click" when the ball (or the pin) matches the indentation.

System 500 may also include one or more of the features and advantages discussed above with reference to one or more of FIG. 1A-FIG. 4.

Figure 5C:
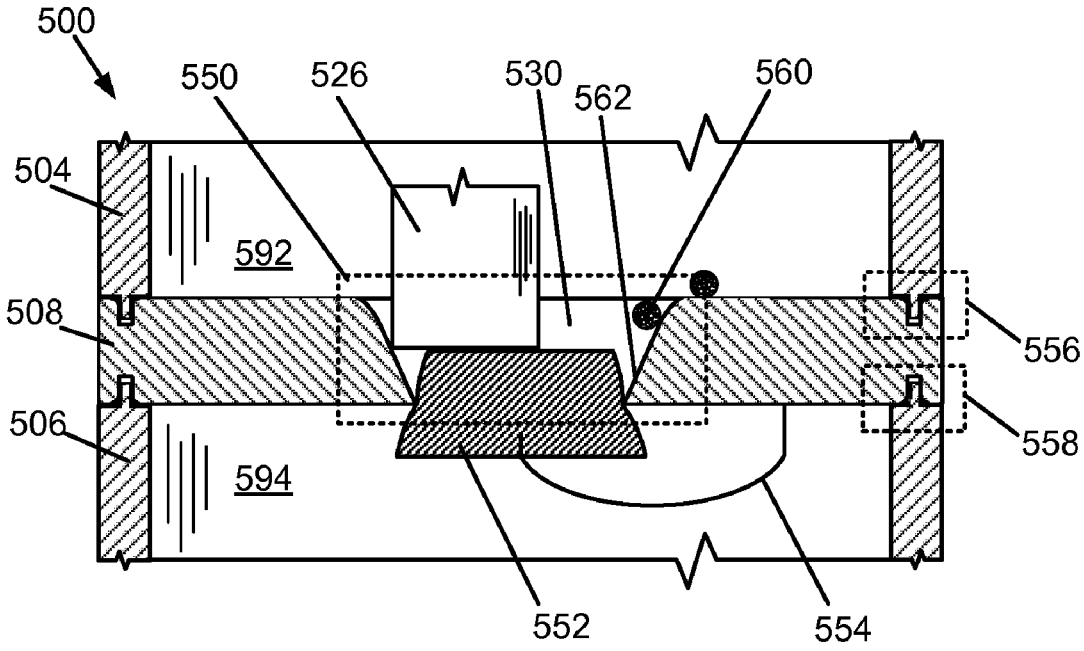
FIG. 5C shows a schematic representation illustrating a cross-sectional view of an intake-facilitating system in accordance with one or more embodiments of the present invention.

FIG. 5C shows a schematic representation illustrating a partial cross-sectional view of intake-facilitating system 500 in accordance with one or more embodiments of the present invention. As illustrated in the example of FIG. 5C, closure unit 546 illustrated in the example of FIG. 5B may be a compressible, resilient plug 552. Plug 552 may be disposed under tube 526, disposed at partition unit 508 (and coupled with partition unit 508), and disposed between portion 504 and portion 506 for receiving a push from tube 526 to open opening 530. Plug 552 may be coupled with partition unit 508 for closing opening 530. Plug 552 may be disposed inside the second space 594, which is configured for containing the second edible substance and/or the edible mixture. At least a portion of opening 530 may be located between plug 552 and the first space 592, which is configured for containing the first edible substance 560.

Plug 552 may be connected to partition unit 508 by a connector 554. Connector 554 is located at a distance from opening 530 such that plug 552 may not interfere with tube 526 after being pushed out of opening 530 by tube 526.

Partition unit 508 may include a designated portion 550 for receiving tube 526 to open opening 530 between space 592 and space 594. Designated portion 550 may include a tapered structure 562 for guiding the insertion of tube 526 through opening 530, for facilitating the flow of the first edible substance 560, and for securing plug 552 in place before plug 552 is pushed by tube 526.

Partition unit 508 may be coupled with portion 504 and portion 506 through pressure-fit mechanism 556 and pressure-fit mechanism 558, respectively. Alternatively or additionally, partition unit 508 may be coupled with portion 504 and portion 506 through one or more well-known detachable coupling mechanisms, such as mating threads.

Figure 5D:
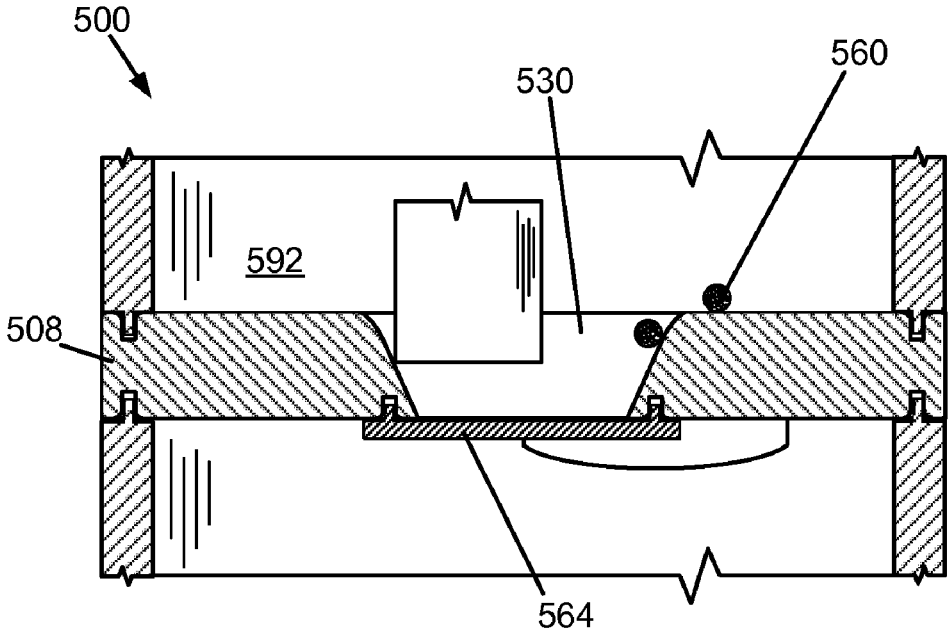
FIG. 5D shows a schematic representation illustrating a cross-sectional view of an intake-facilitating system in accordance with one or more embodiments of the present invention.

FIG. 5D shows a schematic representation illustrating a partial cross-sectional view of intake-facilitating system 500 in accordance with one or more embodiments of the present invention. As illustrated in the example of FIG. 5D, closure unit 546 illustrated in the example of FIG. 5B may be a lid 564 coupled with partition unit 508 through a pressure-fit mechanism. Opening 530 may be located between lid 564 and the first space 592, which is configured for containing the first edible substance.

Figure 5E:
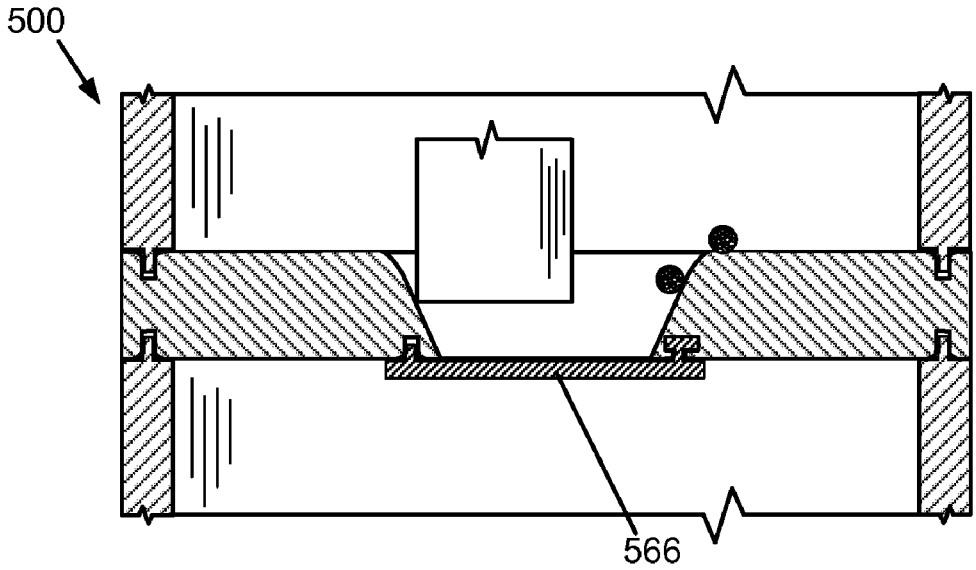
FIG. 5E shows a schematic representation illustrating a cross-sectional view of an intake-facilitating system in accordance with one or more embodiments of the present invention.
Figure 5F:
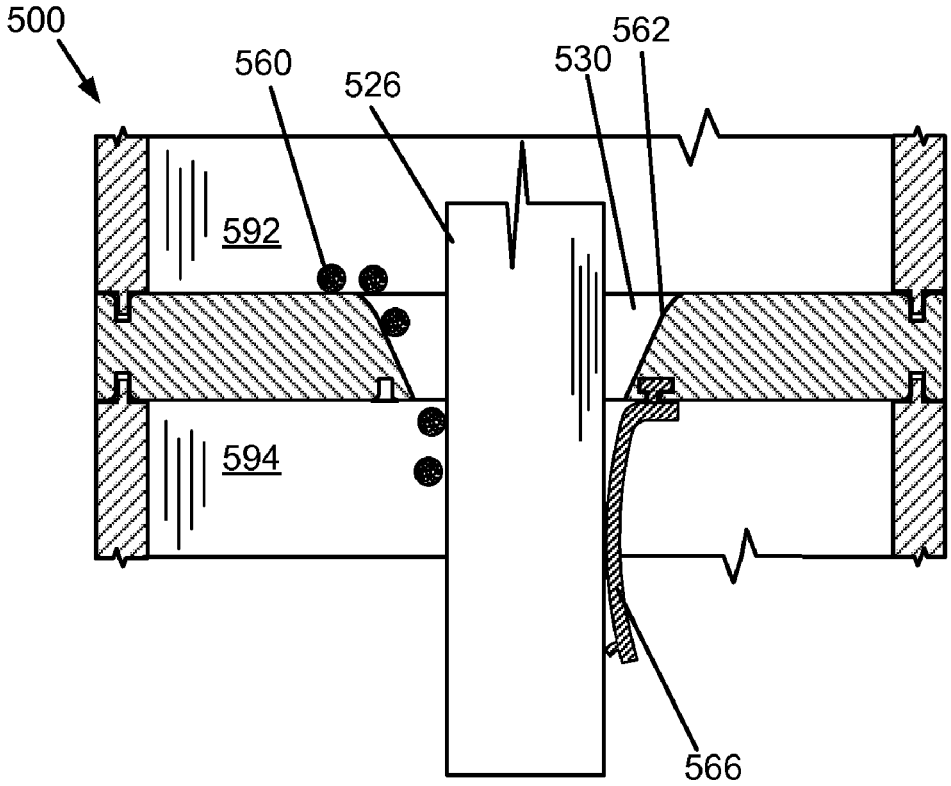
FIG. 5F shows a schematic representation illustrating a cross-sectional view of the intake-facilitating system in accordance with one or more embodiments of the present invention.

FIG. 5E shows a schematic representation illustrating a partial cross-sectional view of intake-facilitating system 500 in accordance with one or more embodiments of the present invention. FIG. 5F shows a schematic representation illustrating a partial cross-sectional view of intake-facilitating system 500 in accordance with one or more embodiments of the present invention. As illustrated in the example of FIG. 5E and FIG. 5F, closure unit 546 illustrated in the example of FIG. 5B may include a resilient member 566. System 500 may include a flow control mechanism that includes resilient member 556, tube 526, and tapered structure 562 (and/or opening 530) for controlling the flow rate of edible substance 560 from space 592 to space 594.

Figure 6:
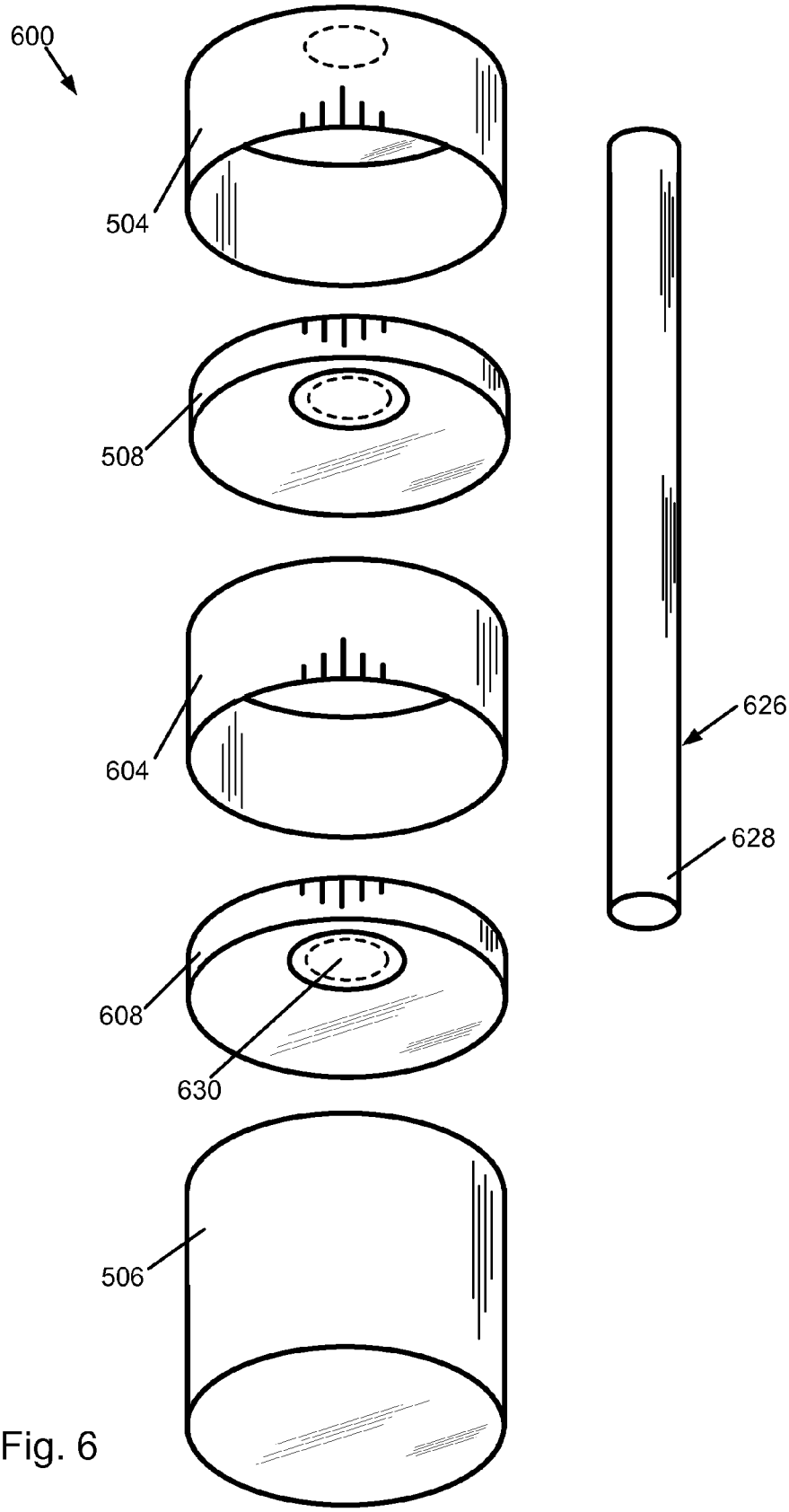
FIG. 6 shows a schematic representation illustrating an exploded view of an intake-facilitating system in accordance with one or more embodiments of the present invention.

FIG. 6 shows a schematic representation illustrating an exploded view of an intake-facilitating system 600 (or "system 600") in accordance with one or more embodiments of the present invention. System 600 may facilitate intake of the mixture of three different edible substances. System 600 may include features and advantages of system 500 illustrated in the examples of FIG. 5A-FIG. 5F. For example, System 600 may include portion 504, portion 506, and partition unit 508. In one or more embodiments, portion 506 may be enlarged for accommodating the edible mixture that includes three edible substances.

System 600 may further include a tube 626 that is longer than tube 526 of system 500.

System 600 may further include a portion 604 disposed between partition unit 508 and second portion 506. Portion 604 may be coupled to portion 504 through partition unit 508. Portion 604 may surround a third space for containing a third edible substance. Portion 604 may have two open ends when portion 604 is detached from partition unit 508 and detached from partition unit 608.

System 600 may further include a partition unit 608 disposed between portion 604 and portion 506. Portion 604 may be coupled to portion 506 through partition unit 608. An opening 630 may be located at partition unit 608. Opening 630 may enable an end portion 628 of tube 626 to move back and forth between portion 604 and portion 506. Opening 630 may further enable at least a portion of the third edible substance to move from portion 604 to portion 506, As can be appreciated from the foregoing, embodiments of the invention may enable the user to perform all of triggering (or starting) the process of mixing of edible substances, controlling the process of mixing of the edible substances, controlling the concentrations of the edible substances in the mixture of the edible substances, and transmitting the mixture of the edible substances utilizing only one tool, a tube. Advantageously, the intake of the mixture of the edible substances may be performed in a convenient manner.

By providing a tube to operate as a straw, embodiments of the invention may minimize spill, without requiring the user to maintain an uncomfortable posture. Advantageously, waste of edible substances and cleaning costs may be minimized. Embodiments of the invention may also enable the intake of the mixture of the edible substances to be performed when the user is on the move, for example, walking or riding a car. Advantageously, the user may be able to save a substantial amount of time.

Embodiments of the invention may enable the user to choose between controlling the addition of the first edible substance into the second edible substance and controlling the addition of the second edible substance into the first edible substance. Advantageously, embodiments of the invention may enable the user to further easily control the process of mixing edible substances according to the user's preferences regarding concentrations of the edible substances.

While this invention has been described in terms of several embodiments, there are alterations, permutations, and equivalents, which fall within the scope of this invention. It should also be noted that there are many alternative ways of implementing the methods and apparatuses of the present invention. Furthermore, embodiments of the present invention may find utility in other applications. The abstract section may be provided herein for convenience and, due to word count limitation, may be accordingly written for reading convenience and should not be employed to limit the scope of the claims. It may be therefore intended that the following appended claims be interpreted as including all such alternations, permutations, and equivalents as fall within the true spirit and scope of the present invention.

What is claimed is:

1. A device for facilitating a user's intake of edible substances, the user having a mouth, the device comprising:

a first portion;

a second portion;

a partition unit disposed between the first portion and the second portion, a first space being located between the first portion and the partition unit for containing a first edible substance, a second space being located between the second portion and the partition unit for containing a second edible substance that is different from the first edible substance; and a tube at least for causing a change at the partition unit to open an opening between the first space that contains the first edible substance and the second space that contains the second edible substance, and for transmitting breakfast cereal included in at least a portion of an edible mixture from the second space through the first space to the mouth, the tube having at least two holes and an end portion, one of the at least two holes being disposed at the end portion, the edible mixture including at least part of the first edible substance provided from the first space through the second space and at least part of the second edible substance provided from the second space.

2. The device of claim wherein the partition unit includes a region disposed under the tube and disposed between the first portion and the second portion for receiving a push from the tube to open the opening, and wherein a shape of the cereal in the tube is substantially similar to a shape of the cereal in the first space or the second space before the tube causes the change.

3. The device of claim 1 further comprising a reusable closure unit disposed under the tube, disposed at the partition unit, and disposed between the first portion and the second portion for receiving a push from the tube to open the opening.

4. The device of claim 1 wherein the tube is disposed through the first portion and the first space with the end portion being placed inside the second space.

5. The device of claim 1 wherein the partition unit includes at least a deformable member disposed under the tube and disposed between the first portion and the second portion for receiving a push from the tube to open the opening.

6. The device of claim 5 wherein the deformable member includes at least a reinforced portion to be contacted by the tube for receiving a force provided by the tube, the reinforced portion being more rigid than another portion of the deformable member.

7. The device of claim 5 wherein the partition unit includes at least a resilient material, the deformable member being configured to close at least a portion of the opening when the end portion is moved away from the deformable member.

8. The device of claim 5 further comprising a flow rate control mechanism including at least the end portion and the deformable member, wherein disposing the end portion at a first position deforms the deformable member to a first extent to open the opening to a first size to cause a first flow rate of the first edible substance from the first space to the second space, and disposing the end portion at a second position deforms the deformable member to a second extent to open the opening to a second size to cause a second flow rate of the first edible substance from the first space to the second space, the second position being lower than the first position, the second flow rate being greater than the first flow rate.

9. The device of claim 5 further comprising at least one protrusion coupled to at least one inner wall of at least one of the first portion and the second portion for securing the deformable member in place before the opening is opened, the opening being located between the at least one protrusion and the deformable member after the opening has been opened, the tube being positioned between the at least one protrusion and the deformable member after the opening has been opened.

10. The device of claim 1 wherein the tube penetrates through the partition unit to result in the opening between the first space and the second space, the tube being further configured for controlling, a flow of the first edible substance from the first space through the opening to the second space, the tube being movable relative to the partition unit and movable through the opening for moving the end portion from the first space to the second space and for moving the end portion from the second space to the first space, the tube allowing at least a portion of the first edible substance to move from the first space through the opening to the second space when the end portion is disposed inside the first space, the tube reducing the flow of the first edible substance from the first space through the opening to the second space when the end portion is disposed inside the second space and when the tube is disposed through the opening, the tube transmitting the portion of the edible mixture from the second space to the mouth when the end portion is disposed inside the second space and when the tube is disposed through the opening.

11. The device of claim 1 further comprising a flow rate control mechanism including at least the end portion, the partition unit, and the opening, wherein the end portion is asymmetric with respect to any plane parallel to the partition unit when the tube is disposed perpendicular to the partition unit, disposing the end portion partly inside the first space and partly inside the second space causes a first flow rate of the first edible substance from the first space through the opening to the second space, and disposing the end portion completely inside the first space causes a second flow rate of the first edible substance from the first space through the first opening to the second space, the second flow rate being greater than the first flow rate.

12. The device of claim 1 further comprising a mechanism for enabling the user to choose between controlling addition of the first edible substance into the second edible substance and controlling addition of the second edible substance into the first edible substance, the mechanism including at least a first designated portion disposed at the first portion for facilitating insertion of the tube through the first portion and the first space into the second space for controlling a flow of the first edible substance from the first space to the second space, and a second designated portion disposed at the second portion for facilitating insertion of the tube through the second portion and the second space into the first space for controlling a flow of the second edible substance from the second space to the first space.

13. The device of claim 12 wherein a first imaginary straight line perpendicular to the partition unit passes through the first designated portion, and a second imaginary straight line perpendicular to the partition unit passes through the second designated portion, the second imaginary straight line being parallel to the first imaginary straight line.

14. The device of claim 12 further comprising:

a first closure unit, the first closure unit being disposed at the first portion for covering a second opening, the second opening being located at the first designated portion; and a second closure unit, the second closure unit being disposed at the second portion for covering a third opening, the third opening being located at the second designated portion.

15. The device of claim 14 further comprising:

a first structure coupled with the first portion and surrounding the first closure unit, the first structure and the first portion forming a first container when the first portion is disposed under the first structure, the first container being configured to collect spill coining from the second opening, the first structure being configured to support the device when the first structure is disposed under the first portion; and a second structure coupled with the second portion and surrounding the second closure unit, the second structure and the second portion forming a second container when the second portion is disposed under the second structure, the second container being configured to collect spill coming from the third opening, the second structure being configured to support the device when the second structure is disposed under the second portion.

16. The device of claim 1 wherein the partition unit includes a designated portion for receiving the tube to open the opening between the first space and the second space, the designated portion including a tapered structure that guides insertion of the tube through the opening and facilitates a flow of the first edible substance.

17. The device of claim 1 further comprising a reusable closure unit connected to the partition unit for closing the opening, the reusable closure unit being disposed inside the second space, at least a portion of the opening being located between the reusable closure unit and the first space, the tube being, configured to open the reusable closure unit.

18. The device of claim 1 wherein the opening is located at the partition unit for receiving the tube, the partition unit includes at least a first feature, a second opening is located at the first portion for receiving the tube, the first portion includes at least a second feature, the opening located at the partition unit aligns with the second opening located at the first portion such that an imaginary line perpendicular with the partition unit passes through both the opening and the second opening when the first feature matches the second feature, and the opening located at the partition unit does not align with the second opening when the first feature, does not match the second feature.

19. The device of claim 1 further comprising:

a third portion disposed between the partition unit and the second portion, the third portion being coupled to the first portion through the partition unit, the third portion surrounding a third space for containing a third edible substance; and a second partition unit disposed between the third portion and the second portion, the third portion being coupled to the second portion through the second partition unit, a second opening being located at the second partition unit, the second opening enabling the end portion of the tube to move back and forth between the third portion and the second portion, the second opening further enabling at least a portion of the third edible substance to move from the third portion to the second portion, wherein the edible mixture includes at least part of the third edible substance, and the third portion has two open ends when the third portion is detached from the partition unit and detached from the second partition unit.

20. The device of claim 1 further comprising a chemical heating unit coupled with the second portion for heating at least one of the second edible substance and the edible mixture.

21. The device of claim 1 wherein the tube is made of a metal material.

22. A method for facilitating; intake of edible substances, the method comprising:

obtaining a container, the container including at least a first portion, a second portion, and a partition unit disposed between the first portion and the second portion, a first space being located between the first portion and the partition unit for containing a first edible substance, the second space being located between the second portion and the partition unit for containing a second edible substance that is different from the first edible substance;

obtaining a tube, the tube having an end portion and at least two holes;

using the tube to cause a change at the partition unit to open an opening between the first space that contains the first edible substance and the second space that contains the second edible substance; and transmitting, using the tube, breakfast cereal included in at least a portion of an edible mixture from the second space through the first space to the mouth, the edible mixture including at least part of the first edible substance provided from the first space through the second space and at least part of the second edible substance provided from the second space.

23. The method of 22 further comprising:

putting the tube through the first portion;

positioning the tube through the opening to dispose the end portion inside the second space;

after the positioning, moving the tube to move the end portion from the second space to the first space for allowing at least a portion of the first edible substance to move from the first space to the second space; and after the moving, repositioning the tube to move the end portion from the first space to the second space to enable the transmitting.

24. The method of claim 23 further comprising:

rotating the container to position the first portion and the second portion at a same level before performing the positioning; and inserting the tube from an upper portion of the first portion.

25. The method of claim 22 further comprising:

pushing the tube through the first space to dispose the end portion inside the second space; and using the end portion to push a closure unit that is located at the partition unit to open the opening, at least a portion of the opening being disposed between at least a portion of the closure unit and the first space, the portion of the closure unit being disposed inside the second space.

26. The method of claim 22 further comprising:

covering a second opening that is located at the first portion;

after the covering, flipping the container to dispose the second space above the first space; and after the covering, inserting the tube through the second portion and through the opening between the first space and the second space.

27. The method of claim 22 further comprising:

after the transmitting, shifting the tube to move the end portion from the second space to the first space for allowing, more of the first edible substance to move from the first space to the second space; and after the shifting, replacing the tube through the partition unit to decrease addition of the first edible substance into the second edible substance, wherein the replacing the tube through the partition unit moves the end portion from the second space to the first space.

28. The method of claim 22 further comprising:

disposing the end portion partly inside the first space and partly inside the second space to cause a first flow rate of the first edible substance from the first space to the second space; and disposing the end portion completely inside the first space to cause a second flow rate of the first edible substance from the first space to the second space, the second flow rate being greater than the first flow rate, wherein the end portion is asymmetric with respect to any plane parallel to the partition unit when the tube is disposed perpendicular to the partition unit.

29. The method of claim 22 further comprising pushing the tube through the partition unit to form a second opening between the first space and the second space for generating an additional flow of the first edible substance from the first space to the second space.

30. The method of claim 22 further comprising:

using the tube to deform at least a portion of the partition unit to form a region between the partition unit and the second portion, the end portion of the tube being disposed inside the region; and mixing a portion of the first edible substance and a portion of the second edible substance inside the region.

31. A device for facilitating a user's intake of edible substances, the user having a mouth, the device comprising:

a first portion;

a second portion;

a partition unit disposed between the first portion and the second portion, a first space being located between the first portion and the partition unit for containing a first edible substance, a second space being located between the second portion and the partition unit for containing a second edible substance that is different from the first edible substance;

a tube at least for causing a change at the partition unit to open an opening between the first space that contains the first edible substance and the second space that contains the second edible substance, and for transmitting at least a portion of an edible mixture to the mouth, the tube having at least two holes and an end portion, one of the at least two holes being disposed at the end portion, the edible mixture including at least part of the first edible substance provided from the first space through the second space and at least part of the second edible substance provided from the second space; and a reusable closure unit configured for closing the opening to prevent a potential liquid flow and including a coupling structure kw coupling with the partition unit, wherein the end portion of the tube is configured to be moved in the first space toward the reusable closure unit to provide a push to the reusable closure unit for decoupling the coupling structure from the partition unit to open the opening.

32. The device of claim 31 wherein a top side of the reusable closure unit is configured to receive the push, wherein the top side of the reusable closure unit includes the coupling structure, and wherein a bottom side of the partition unit includes a matching structure for coupling with the coupling structure.

33. The device of claim 31 wherein the reusable closure unit includes a bottom side disposed inside the second space before the reusable closure unit receives the push and includes a top side disposed between the bottom side and the first space before the reusable closure unit receives the push, and wherein the bottom side is larger than the top side.

34. The device of claim 31 wherein the reusable closure unit is coupled with the partition unit through both a first coupling mechanism and a second coupling mechanism, the first coupling mechanism including the coupling structure and being more detachable than the second coupling mechanism.

35. The device of claim 31 further comprising a connector disposed inside the second space and connecting the reusable closure to the partition unit.

36. The device of claim 31 wherein partition unit is coupled with the second portion through a detachable coupling mechanism.

37. A method for facilitating intake of edible substances, the method comprising:

obtaining a container, the container including at least a first portion, a second portion, and a partition unit disposed between the first portion and the second portion, a first space being located between the first portion and the partition unit for containing a first edible substance, the second space being located between the second portion and the partition unit for containing a second edible substance that is different from the first edible substance;

obtaining a tube, the tube having an end portion and at least two holes;

using a coupling structure of a reusable closure unit to couple the reusable closure unit with the partition unit for closing the opening, with the tube being spaced from the reusable closure unit;

moving the tube toward the reusable closure unit;

using the tube to push the reusable closure unit to wen an opening between the first space that contains the first edible substance and the second space that contains the second edible substance;

transmitting, using the tube, at least a portion of an edible mixture to the mouth, the edible mixture including at least part of the first edible substance provided from the first space through the second space and at least part of the second edible substance provided from the second space; and reusing the coupling structure of the reusable closure unit to couple the reusable closure unit with the partition unit for closing the opening to prevent a potential fluid flow, with the tube being spaced from the reusable closure unit.

38. The method of claim 37 further comprising decoupling the second portion from the partition unit before performing the reusing.

39. The method of claim 37 wherein the tube pushes on a top side of the reusable closure unit to open the opening, and wherein the reusing includes pushing on a bottom side of the reusable closure unit.

* * * * *

UNITED STATES PATENT AND TRADEMARK OFFICE

CERTIFICATE OF CORRECTION

PATENT NO. : 8,354,130 B2
APPLICATION NO. : 12/876258
DATED : January 15, 2013
INVENTOR(S) : Yi-Ming Tseng It is certified that error appears in the above-identified patent and that said Letters Patent is hereby corrected as shown below:

Column 20, Line 30, i.e., Claim 22, first line, the "facilitating; intake" should read -- facilitating intake --.

Column 22, Line 14, i.e., Claim 31, 25th line, the "structure kw coupling" should read -- structure for coupling --.

Column 22, Line 62, i.e., Claim 37, 19th line, the "to wen an" should read -- to open an --.

Signed and Sealed this
Second Day of April, 2013

Teresa Stanek Rea
*Acting Director of the United States Patent and Trademark Office*